United States Patent [19]

Uffmann

[11] Patent Number: 5,052,862

[45] Date of Patent: Oct. 1, 1991

[54] TRENCH SUPPORTING ASSEMBLY

[75] Inventor: Hans-Peter Uffmann, Aachen, Fed. Rep. of Germany

[73] Assignee: Krings Verbau GmbH, Heinsberg-Dremmen, Fed. Rep. of Germany

[21] Appl. No.: 507,714

[22] Filed: Apr. 10, 1990

[30] Foreign Application Priority Data

Apr. 12, 1989 [DE] Fed. Rep. of Germany ..... 3911918
Mar. 24, 1990 [DE] Fed. Rep. of Germany ..... 4009528

[51] Int. Cl.[5] ..... E02D 17/08
[52] U.S. Cl. ..... 405/282; 248/357
[58] Field of Search ..... 405/272, 282, 283, 288, 405/290; 248/351, 357

[56] References Cited

U.S. PATENT DOCUMENTS

| | | | |
|---|---|---|---|
| 2,574,857 | 11/1951 | Ball | 248/357 X |
| 3,001,754 | 9/1961 | Fowler | 248/357 |
| 3,881,679 | 5/1975 | Krings | 405/282 X |
| 3,950,952 | 4/1976 | Krings | 405/282 |
| 4,004,771 | 1/1977 | Plevak et al. | 248/357 |
| 4,139,324 | 2/1979 | Krings | 405/282 |

FOREIGN PATENT DOCUMENTS

| | | | |
|---|---|---|---|
| 624962 | 11/1962 | Belgium | 248/357 |
| 268710 | 6/1913 | Fed. Rep. of Germany | 405/282 |
| 2832321 | 1/1980 | Fed. Rep. of Germany | 405/282 |
| 2230836 | 12/1974 | France . | |
| 73914 | 4/1985 | Japan | 405/282 |

*Primary Examiner*—David H. Corbin
*Attorney, Agent, or Firm*—Herbert Dubno; Yuri Kateschov

[57] ABSTRACT

The trench assembly comprises shoring plates supporting the side walls of the trench, vertical posts holding the shoring plates and at least one spindle or shore for the support of two oppositely located posts, the plates, include respective front sides pressed against the associated posts and curved in the vertical plane so that they can roll on the posts when the assembly is lowered.

13 Claims, 3 Drawing Sheets

TRENCH SUPPORTING ASSEMBLY

FIELD OF THE INVENTION

The present invention concerns a means for shoring trenches comprising shoring plates supporting the side walls of the trench, vertical posts holding the shoring plates and at least one spindle or shore for the support of two oppositely located posts, wherein in the installed condition the two spindle feet are pressed with their front sides against the associated posts.

BACKGROUND OF THE INVENTION

Such means is known from German patent 2 702 750. According to this known means the spindle is pivotally supported at two sliding shoes which are guided in corresponding posts. The spindle foot includes a supporting plate having at its upper and lower end springs which are supported at spring disks engaging the inner side of the post.

According to such a shoring means the spindle can be pivoted relative to the post at a certain angle so that the shoring plates with the posts can be successively and alternately lowered on both sides of the trench which is to be excavated. If one side of the shoring means is located lower than the other side, an inclined position of the spindle results so that the lower or upper spring is correspondingly loaded or unloaded. Such an inclined position of the spindle necessarily causes an inward movement of the two oppositely located posts so that the shoring means is inwardly moved towards the middle of the trench. Accordingly, with the provision of two spindles located one above the other a parallelogram results from a rectangle. Through the inward movement of the shoring means the ground settles so that during the next lowering on one side, according to which the spindle parallelogram is again transformed into a spindle rectangle, it has to be worked against an increased ground pressure, i. e. the settled ground has to be again pressed away for attaining the normal trench width. This movement brings along an increased loading of the posts, shoring plates and spindles.

From European patent 0 095 193 a shoring means is known according to which a spindle or shore is provided with curved front sides which are supported at a corresponding post by means of pad-like resilient means. The respective spindle feet are pivotally supported at the posts. Upon pivoting of the spindle relative to the post the pad-like resilient means are more and more compressed so that their spring stiffness increases. Since, according to this means a fixed pivot point of the spindle is provided at the post either, upon an inclined position of the spindle relative to the post, a corresponding inward movement of the post results which brings along a reduction of the trench width together with a corresponding settling of the ground. It is but proposed in European patent 0 095 193 to support the spindle at the post by means of an elongated hole, however, by the provision of such an elongated hole it is to be achieved only slight pivotal movements of the spindle about a vertical axis as well as movements in axial direction of the spindle. Accordingly, a co-movement of the post cannot be excluded in this case either.

OBJECTS OF THE INVENTION

It is therefore an object of the present invention to provide a shoring means preventing an inward movement of the posts upon lowering the means or the alternate lowering of the shoring plates relative to one another carried out in especially large steps.

SUMMARY OF THE INVENTION

With a shoring means according to the invention this problem is solved by the feature that the front sides of the spindle feet are curved in the vertical plain and are supported on the posts in a rollable manner.

Thus, according to the invention solution there is neither fixed support of the spindle feet on the posts themselves nor sliding shoes which are guided within the posts, a structure that has the disadvantage of an inflexible arrangement having the result of an inward movement of the posts or of the shoring plates upon a correspondingly large pivoting of the spindles. Thus, according to the invention two spindle feet roll on the posts and when one spindle is lowered relative to the other spindle the two force impact points between the spindle feet and the posts also migrate. Since no fixed connection between the spindle and the post exists which would interfere with such a rolling process, the post is not pulled toward the middle of the trench by the corresponding rolling movement and it remains in its vertical position, so that a distance with respect to the oppositely located post is maintained.

Accordingly, the above-desired rolling process is realized by the alternate lowering of the two sides of the shoring means. This rolling process corresponds to a process of rotation of the spindle about a rotational point located in the middle of the trench.

Practically, the radius of curvature of the front sides approximately corresponds to half of the trench width. According to this embodiment the above-described rolling process can be realized best. This would means that for each trench width a specially formed spindle were necessary. However, in practice one will use for a certain range of trench widths one and the same spindle in order not to have to keep in readiness too many spindle sizes. With such a mean curvature of the spindle foot front side approximately the same effect can be attained as described above. So, for instance, with a trench width of between 1 and 2 m a spindle can be used the spindle foot having a mean radius of curvature of 0.75 m.

Obviously, if any holding of the spindle at the posts is missing, only in the pressing condition of the same, i. e. in the installed condition of the shoring means with corresponding ground pressure, falling down of the spindle from the posts is prevented. In the erecting condition of the shoring means prior to the excavation of the trench the spindle would have to be retained by additional measures so that it does not fall down from the posts. In order to avoid this and to couple the spindle with the posts to make the handling more easy, according to a further embodiment of the invention, the spindle feet are laterally held at the post in a manner which does not interfere with the rolling movement. It is of essential importance for the invention that this holding is realized in such a manner that the above-described rolling movement of the spindle foot on the post is not interfered move inwardly bringing along a settling of the ground on account of an interference with the movement of the spindle foot relative to the post. This holding of the post feet is appropriately realized by means of bolts located at the spindle foot which are located in overdimensioned recesses of the post. Since the spindle does not carry out any pivotal movement about these bolts relative to the post, the bolt fulfills only a holding function in order to prevent falling down of the spindle from the post. The recesses of the post have to be formed with such a size that the movement of the bolts whithin the recesses is not interfered with the maximum admitted rolling condition which, for example, can be determined by stops.

If such holding means for the spindle on the post are provided, the bolts of the spindle foot engage the lower edge of the provided recesses. However, in this position it is not assured that post and spindle are in a right-angled position with respect to one another since the engagement area of the spindle foot with the post has the above-cited curvature so that inclined positions between spindle and post can result. In order to prevent this, resilient means are appropriately provided at the spindle foot above and below the longitudinal axis of the spindle. These resilient means provide for a right-angled position between spindle and post in the non-installed condition of the shoring means. With other words, these resilient means, which can be for instance resilient pillows, springs etc., counteract an inclined position of the post relative to the spindle foot since they generate a counter force on account of their bias.

Preferably, these resilient means are springs bearing in recesses of the spindle foot and supported at the post. The corresponding bias of the springs can be adjusted by means of appropriate adjusting means.

According to a further embodiment of the invention the post is formed as C-profile and the spindle foot is rollably supported at the inner side of the post wall adjacent to the ground. This C-shape of the post has the advantage that a certain guidance of the post foot in lateral direction is achieved, i. e. the spindle foot cannot slide off the post in lateral direction. Hereby the rolling process in the vertical plane of the spindle axis is assured and a distortion or tilting of the spindle foot is prevented. However, the spindle foot should be disposed in the post with some lateral play in order to allow slight lateral movements and to not endanger the rolling process in the vertical plane by a jamming or sticking. According to an especially prefered embodiment of the invention the spindle foot is also curved on its side adjacent to the middle of the trench. This embodiment also enables a rolling movement of the spindle foot on the side of the post adjacent to the middle of the trench, i. e. on the inner side of the two projecting flanges of the C-profile if the post is formed as C-profile. In certain positions of installation of the shoring means a contact of the spindle foot with the inner side of the post can take place. According to the invention, also in this case a migration of the force impact point is achieved by the corresponding rolling movement. Thus, a relative movement between spindle foot and post is enabled which prevents a movement of the post upon a corresponding inclination of the spindle.

According to a further feature of the invention a dirt-rejecting seal is provided on the upper side of the spindle foot, said seal being in contact with the inner sides of the post. This seal prevents that soil gets stuck between the spindle foot and the inner sides of the post which might interfere with or prevent a corresponding rolling process of the spindle foot within the post.

Of course, according to the inventive shoring means spindle foot and spindle can be integrally formed. However, both can also consist of two members which are adapted to be appropriately fixed to one another, for instance to be connected by bolts. Furthermore, both spindle feet can be assembled with a plurality of intermediate members to a spindle unit. These embodiments are known to the expert in the art.

The inventive shoring means includes at least one spindle with two spindle feet which engage two posts. In practice two spindles located one above the other are used with regard to a pair of posts. These spindles form a straining frame. Obviously, the inventive measures have been carried out at both spindles. Even more than two spindles can be located one upon the other.

According to a further prefered embodiment of the inventive shoring means the holding of the spindle feet at the posts is realized by means of bolts which are resiliently supported at the spindle foot. The bolts can be retained in corresponding bores of the posts which are not overdimensioned. By the resilient support of the bolt at the spindle foot it is achieved that the rolling movement of the spindle foot of the inner side of the post is not interfered with by the bolt. In other words, if the spindle foot rolls on the inner side of the post the bolt migrates relative to the spindle foot wherein the provided resilient bearing is compressed more ore less. On the other side this bearing causes a centering of the bolt relative to the spindle foot in the unloaded or slightly loaded condition of the shoring means whereby altogether an inclination of the posts with the shoring plates, for instance prior to lowering into the ground, is prevented.

Accordingly, due to this embodiment additional resilient means providing for a right-angled position between spindle and post in the non-installed condition and described in the patent claims 5 and 6 can be omitted. Preferably, a bearing of rubber or a corresponding resilient material serves as resilient bearing which is disposed in a lateral bore of the spindle foot. In other words, here is a bore which is overdimensioned relative to the bolt wherein the interspace between the wall of the bore and the bolt is filled by the rubber bearing. The resiliency of the rubber bearing is such that the bolt is centered hereby in the unloaded or slightly loaded condition of the shoring means, however, can migrate from its centered position with pressing the rubber bearing upon high loads. As mentioned, the rolling movement of the spindle foot is not interfered with in this manner. Appropriately, a rubber bushing surrounding the bolt in the bore of the spindle foot is used as rubber bearing. However, this shall not exclude the even differently formed constructions can be used if they only have a centering function on the one side and can be compressed upon a corresponding high load on the other side so that the bolt can migrate relative to the spindle foot.

According to a further feature of the inventive shoring means the spindle foot has on its side adjacent to the middle of the trench a sufficient distance with regard to the inner side of the post so that the rolling movement of the spindle foot is not interfered with by missing contact of this spindle foot side with the inner side of the post. Preferably, the side of the spindle foot adjacent to the middle of the trench is obliquely shaped so that the spindle foot tapers from its center up to the upper or lower end.

It was already mentioned above that measures have been made in order to prevent sticking of soil between the spindle foot and the inner sides of the post since this would interfere with or prevent a corresponding rolling process of the spindle foot within the post. For supplementing these measures it is still proposed that the spindle foot has longitudinal grooves (i. e. vertically running grooves) on its curved front side. By these grooves it is achieved that small stones or soil cannot stick between the front side of the spindle foot and the inner side of the post but can be rather discharged through the grooves.

BRIEF DESCRIPTION OF THE DRAWINGS

The above and other features and advantages of the present invention will become more readily apparent from the following description, reference being made to the following accompanying drawing:

FIG. 6 is a vertical sectional view of an inner surface of he spindle foot showing a pair of longitudinal recesses.

SPECIFIC DESCRIPTION

Figure 1:
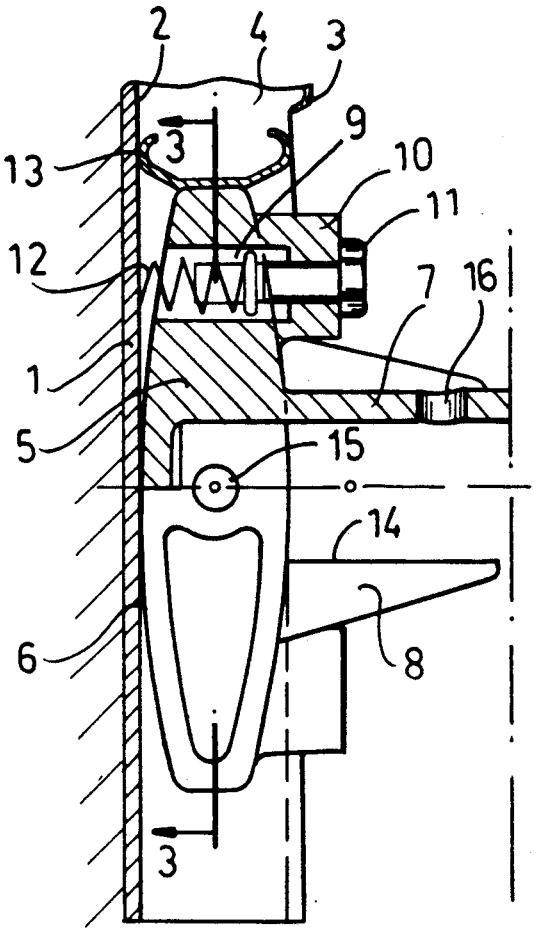
FIG. 1 shows a vertical sectional view through a part of the supporting assembly showing the spindle foot in contact with the post.
Figure 1A:
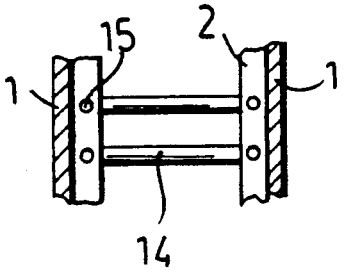
FIG. 1A is a schematic fragmentary vertical sectional view of the supporting assembly
Figure 2:
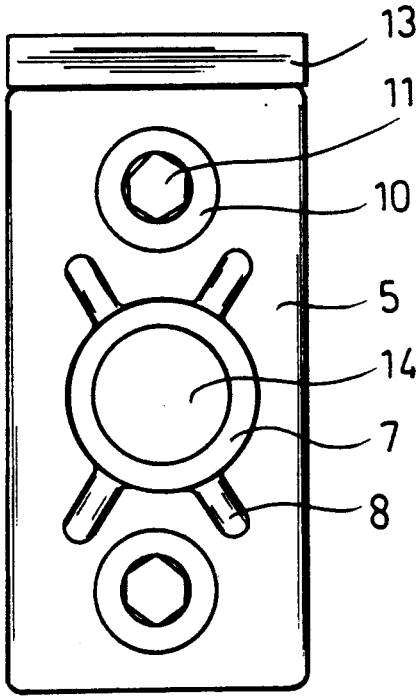
FIG. 2 shows a top plan view of the spindle foot in the direction from the middle of the trench.
Figure 3:
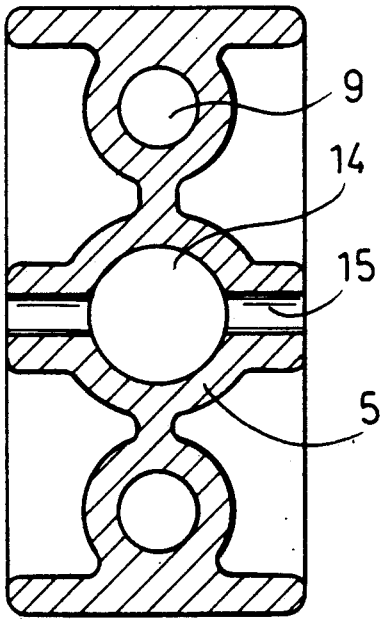
FIG. 3 shows a vertical sectional view along line 3—3 in FIG. 1.

The FIGS. 1 to 3 show a part of a means for shoring trenches consisting of shoring plates supporting the side walls of the trench, vertical posts holding the shoring plates and at least one spindle or shore for the support of two oppositely located posts. According to the shown embodiment two spindles located one above the other form a straining frame with which the posts and thus the shoring plates are spaced from one another.

Each spindle which consists of a plurality of members which can be prolonged and shortened by means of corresponding thread connections has two spindle feet 5 which contact one of two oppositely located posts 1, respectively. FIG. 1 shows a vertical sectional view through a spindle foot 5 of such a spindle which is in engagement with a post 1.

According to this embodiment the post 1 is C-shaped in cross-section and has a wall 2 adjacent to the ground which has to be supported, two side walls 4 and two flanges 3 adjacent to the middle of the trench which are parallel with respect to the wall 2 and which form a longitudinal slot between them. Laterally at the post corresponding holding means for the shoring plates are disposed which extend between two posts, respectively.

The spindle foot 5 which is shown here comprises a longitudinal foot portion and a tube-like portion 7 formed integrally therewith which can be bolted with a suitable spindle member by means of bores 16. Supporting wall portions 8 extend between the foot portion and the tube-like portion 7. FIG. 2 shows a top plan view of the spindle foot 5 from the direction of the middle of the trench while FIG. 3 shows a section through the spindle foot along line 3—3 in FIG. 1. One recognizes that two bosses 10 directed to the center of the trench are provided above and below the tube-like portion 7 of the spindle foot. Recesses 9 are provided in these bosses and extend to the front side 6 of the spindle foot adjacent to the ground. Springs 12 are mounted in these recesses. The compression degree of these springs can be adjusted by an adjusting bolt 11 extending through the boss 10. In the installed condition of the shoring means these springs 12 are supported at the inner side of the wall 2 of the post 1 adjacent to the ground.

In the vertical plane extending through the spindle axis the front side 6 of the spindle foot 5 adjacent to the ground is curved and is provided with longitudinal grooves 61. The radius of curvature approximately corresponds to half of the trench width. By this, a rolling movement of the spindle foot on the inner side of the post wall 2 is possible.

As it can be seen in FIG. 3, two bores 15 extend laterally from the bore 14 of the spindle foot which serves for the receipt of the spindle member. These bores extend to the lateral edges of the spindle foot. They serve for the receipt of holding bolts (not shown) for the spindle foot which further extend through recesses in two side walls 4 of the post. These recesses are overdimensioned with regard to the corresponding holding bolts so that the bolts do not engage the walls of the overdimensioned bores in the side walls 4 of the post during a rolling movement of the spindle foot on the post 1.

The described shoring means has the following function; during the transport of the shoring means or the erection of the same on the ground the springs 12 provide for that the two posts and the two spindles take a right-angled position with regard to one another since the springs prevent an inclination of the posts. A corresponding adjustment of the bias of the springs can be done by means of the adjusting bolts 11 which are disposed in the bosses 10 extending through the slot of the post having a C-profile. In the transport condition or erected condition the two spindles 5 are held in the C-posts by means of the bolts 45, wherein these bolts extend through bores 15 in the above-mentioned recesses of the side walls of the posts. These bolts simultaneously can serve for the fixation of the spindle foot 5 at a corresponding spindle member.

When the shoring means is lowered, the two sides are driven a little bit into the ground so that a fixation of the shoring means in the ground is achieved. Thereafter, the one side is lowered relative to the other side, wherein a rolling process of the corresponding foot on the post well 2 results due to the pressing between the spindle foot and the post wall 2 on both posts. During this process the corresponding pressing point migrates upwardly or downwardly. By this, the distance between the posts is not affected since no tensile forces are applied to the posts by the inclination of the spindle caused by the lowering on one side.

In order to prevent the entering of soil into the post which might interfere with the above-cited rolling process, a corresponding dirt seal 13 is provided at the upper side of the spindle foot. This seal slides along the wall 2 and the flanges 3 of the post.

According to the described embodiment the spindle is bolted (stuck) with the spindle foot at two locations 15 and 16. A triple bolting or multiple bolting (sticking) is also possible.

Figure 4:
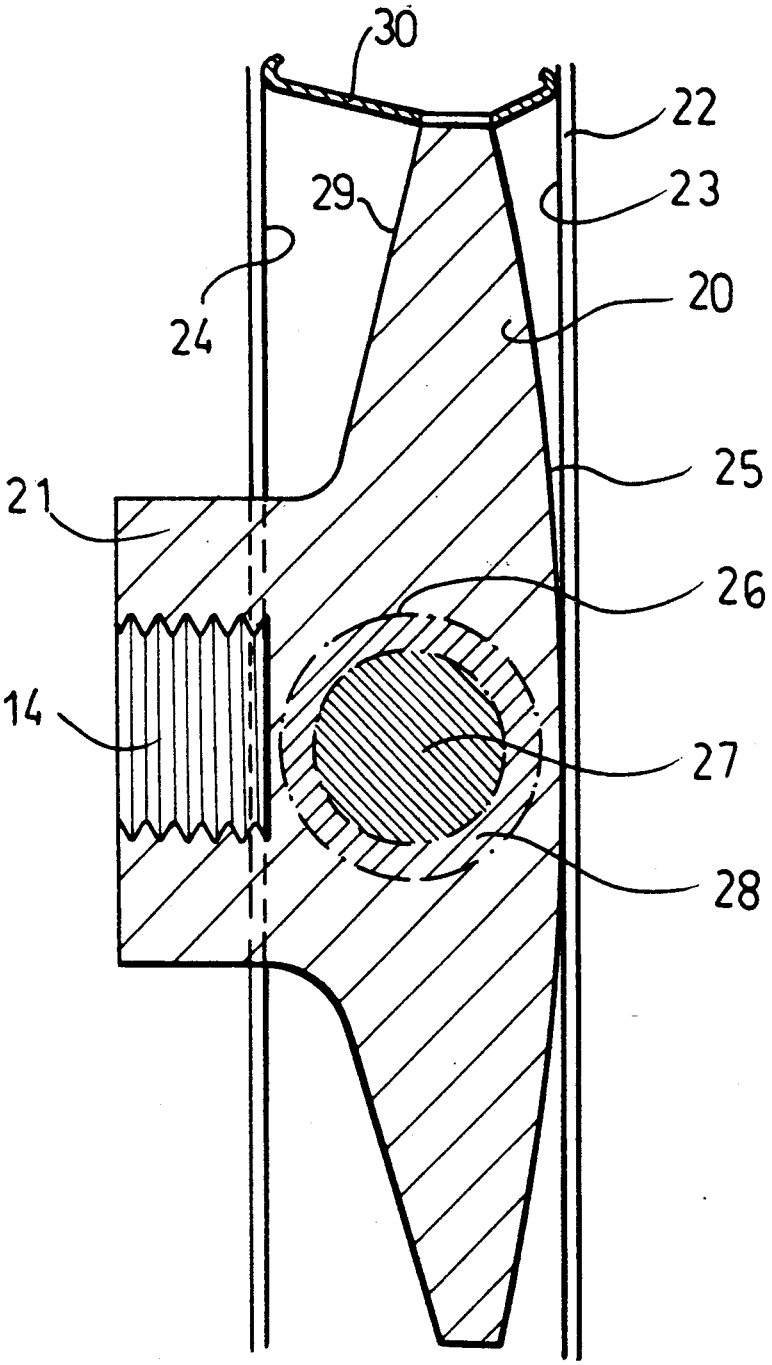
FIG. 4 shows a vertical sectional view through a part of a supporting assembly which uses another embodiment of a spindle foot.
Figure 5:
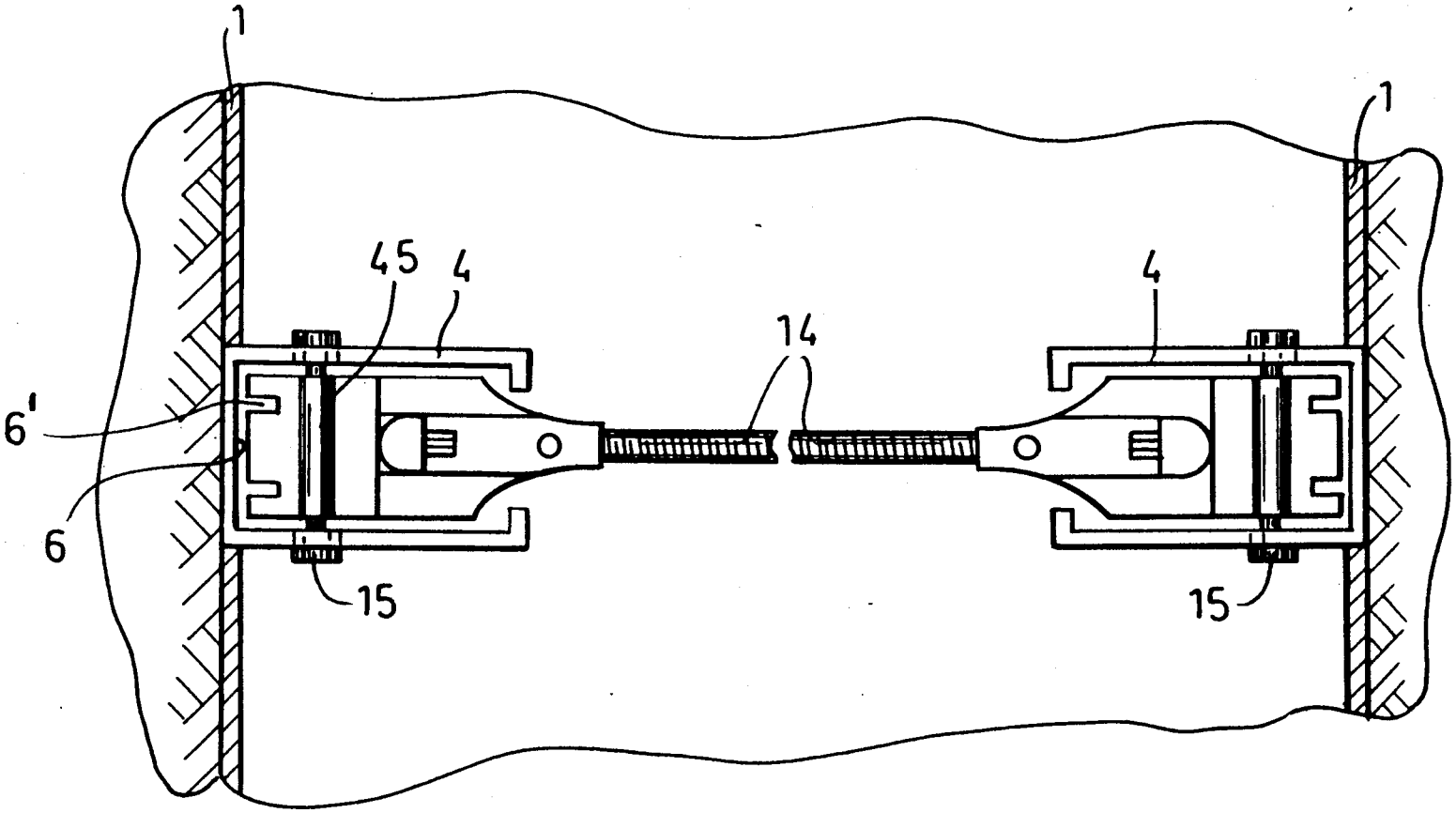
FIG. 5 is a horizontal sectional view of the supporting assembly.

A further embodiment of the invention is shown in FIG. 4. One can see that a spindle foot 20 with a curved front side 25 is disposed within a post 22 having a C-profile in such a manner that the spindle foot with its front side 25 can roll on the inner side 23 of the wall of the post which is adjacent to the ground. Again, the radius of curvature of the front side 25 approximately corresponds to half of the trench width. The spindle foot 20 has a portion 21 directed to the center of the trench which can be connected, for instance bolted, with one or a plurality of spindles.

According to this embodiment the spindle foot 20 is shaped in such a manner that sufficient space remains between the inner side 24 of the side of the post adjacent to the center of the trench and the corresponding back side 29 of the spindle foot so that the rolling movement of the spindle foot is not interfered with by contact of these two surfaces. For this, the back side 29 is obliquely shaped so that the spindle foot tapers from the center upwardly and downwardly. A dirt-rejecting member 30 is disposed at the upper end of the spindle foot.

According to this embodiment the spindle foot is held in the post by means of a transverse bolt 27 extending into the corresponding bores of the post. Here, the bores in the post can be fittingly made with regard to the bolts. If the spindle foot rolls, the bolt 27 migrates from its centered position with regard to the overdimensioned bore 26 in the spindle foot so that the rubber bearing 28 formed as rubber bushing is correspondingly compressed. The rubber bearing has such a resiliency that it holds the bolt in the center in the unloaded or slightly loaded condition of the shoring means, however, allows a migration of the bolt relative to the spindle foot upon a corresponding rolling process. Accordingly, on account of the provision of the rubber bushing one can desist from using additional support springs preventing an inclination of the shoring means in the unloaded condition.

I claim:

1. An assembly for shoring a trench having opposite side walls, said assembly comprising:

respective shoring plates extending generally along opposite side walls of said trench;

a pair of spaced apart posts supporting respective shoring plates on opposite sides of the trench, each of said posts being formed with a respective front wall and at least one lateral wall affixed to said front wall;

at least one spindle positioned between said posts and extending along a spindle axis transverse to a trench axis, said spindle being formed with opposite ends;

a pair of elongated support feet extending vertically generally perpendicular to said spindle axis and braced against said posts, each of said feet being operatively connected with a respective end of said spindle and being provided with a respective curved outer side in rolling contact with the respective front wall of the respective post; and retaining means for holding each of said support feet on the respective post so that said feet can roll on the respective front wall, said retaining means including a bolt passing through the respective lateral wall and resiliently held in a lateral bore formed in the respective foot.

2. The assembly defined in claim 1 wherein said each of said posts is formed with a respective pair of said lateral walls, each of said lateral walls of a post being formed with a respective opening coaxial with the lateral bore of the respective foot, each lateral bore being provided with a rubber bushing surrounding the respective bolt, each bolt extending in the respective foot between the respective pair of lateral walls and received in said openings.

3. The defined in claim 2 wherein said bolt is centered in said lateral bore in a loading of said bushing up to a slight load, said bolt being decentered upon pressing against said rubber bushing at high loads.

4. The assembly defined in claim 2 wherein said rubber bushing extends continuously between the respective pair of lateral walls of the respective post.

5. The assembly defined in claim 2 wherein each of said feet is provided with a further lateral bore extending parallel to the first-mentioned lateral bore.

6. The assembly defined in claim 1, further comprising springs tending to center said feet upon rolling thereof, each of said springs being mounted in a respective recess extending generally parallel to said spindle axis and pressing against the respective post.

7. The assembly defined in claim 2 wherein each of said posts is a C-profile post.

8. The assembly defined in claim 1 wherein each of said support feet is formed with a respective inner side spaced axially inwardly from the respective outer side, said inner sides of said support feet being curved.

9. The trench assembly defined in claim 1 wherein said support feet are provided with means for fixing said feet to said spindle.

10. The trench assembly defined in claim 1 wherein said support feet is formed with a respective dirt-rejecting seal being in contact with the walls of said posts.

11. The trench assembly defined in claim 1 wherein two spaced apart spindles are provided one above the other.

12. The assembly defined in claim 1 wherein the trench has a certain width, said curved outer sides of said feet being formed with a radii approximately corresponding to half of said width.

13. The assembly defined in claim 1 wherein said outer curved sides of said support feet are formed with longitudinal grooves.

* * * * *